US006405736B2

(12) United States Patent
Townsend

(10) Patent No.: US 6,405,736 B2
(45) Date of Patent: Jun. 18, 2002

(54) METHOD OF USING A SELF ADHESIVE HAIR EXTENSION

(76) Inventor: Valerie Townsend, 1515 W. 30th St., Los Angeles, CA (US) 90007

( * ) Notice: Subject to any disclaimer, the term of this patent is extended or adjusted under 35 U.S.C. 154(b) by 0 days.

(21) Appl. No.: 09/833,116

(22) Filed: Apr. 11, 2001

Related U.S. Application Data

(60) Provisional application No. 60/196,181, filed on Apr. 11, 2000.

(51) Int. Cl.[7] ..... A41G 3/00; A41G 5/00
(52) U.S. Cl. ..... 132/201; 132/53
(58) Field of Search ..... 132/201, 53

(56) References Cited

U.S. PATENT DOCUMENTS 2,835,259 A * 5/1958 Goodman ..... 132/53
4,964,428 A * 10/1990 Lamatrice ..... 132/53
5,413,124 A * 5/1995 Incando ..... 132/201
5,575,298 A * 11/1996 Hinton ..... 132/201
6,135,122 A * 10/2000 Campbell et al. ..... 132/201

* cited by examiner

*Primary Examiner*—Todd E. Manahan
(74) *Attorney, Agent, or Firm*—Cleveland R. Williams III

(57) ABSTRACT

The present invention resides in self adhesive hair extensions and a method of attaching then to the head of a wearer. The self adhesive hair extensions comprise a plurality of either natural or synthetic hair strands attached to a base support comprising a strip of woven material or hair attachment weave or welt at one end. A fastener comprising a self adhesive tape portion and removable backing is sewn or otherwise secured by stitching to the hair extensions in order to prevent the adhesive tape from being separated or repositioned during use. The method of use comprise separating a users hair along a part line into an upper portion and a lower portion wherein the upper portion is temporarily swept up and away from the part line. The removable backing is removed from the adhesive hair fastener exposing the removable self adhesive tape, said self adhesive tape is applied to the scalp or back of head of user.

10 Claims, 2 Drawing Sheets

METHOD OF USING A SELF ADHESIVE HAIR EXTENSION

This application claims priority from provisional application No. 60/196,181, filed Apr. 11, 2000.

BACKGROUND OF THE INVENTION

1. Field of the Invention

This version of the invention is concerned with the field of devices and methods that provide the appearance of longer or thicker hair. More specifically, this version of the invention is concerned with a hair attachment comprised of natural or synthetic hair that is releasably attached directly to the hair or scalp of a wearer in order to provide the wearer with the appearance of longer or thicker hair.

It is a common desire among many people to acquire hair that is longer and thicker than that which they possess for a variety of reasons, such as self esteem and satisfaction, quickly changing fashion styles, and the like. For instance, short hair may, which is in fashion for a period of time, may quickly be replaced as current fashion with longer, fuller hairstyles. As hair grows at the rate of approximately less than one inch per month, many people find that it is exceedingly difficult to acquire a contemporary hairstyle in a reasonable amount of time. Even when someone possesses hair of substantial length, the hair may lack the thickness or overall volume to achieve a desirable hairstyle. Others may find that their hair grows unevenly and that constant attention and trimming may be required to maintain a desired look.

Various devices and techniques are available in the prior art and in the marketplace that attempt to satisfy the need and desire for longer and thicker hair. A common and well known item is a wig, whereby the hair of the wearer is completely covered by a cap like article to which natural or synthetic hair is attached. Although wigs provide a quick and easy means to achieve longer hair, they do not present a fully natural appearance, a condition that leads to their recognition when they are being worn. More recently, a variety of more natural hair enhancement techniques have become popular with a variety of users. These consist of hair weaves, hair extensions, hair braiding and the like, whereby natural or synthetic hair is attached to the scalp of existing hair of a wearer by a variety of techniques in order to provide the appearance of longer, thicker hair without the noticeable artifice of a wig. These techniques, which overcome the obvious disadvantages of a wig, also suffer from several drawbacks as they are relatively expensive and time consuming to acquire and frequently discomfit the wearer during application.

2. Description of the Prior Art

Numerous designs, devices, and methods for hair lengthening and enhancement have been provided in the prior art. Even though these designs may be suitable for the specific individual purposes to which they address, they would not be suitable for the purposes of the present version of the invention as they involve relatively elaborate and time consuming techniques and methods as referenced earlier. These techniques are exemplified by U.S. Pat. No. 5,072,745, Hair Extension Process, issued to Cheh on Dec. 17, 1991; U.S. Pat. No. 5,107,867, Process for Extending Human Hair, issued to Barrington on Apr. 28, 1992; U.S. Pat. No. 5,868,145, Hair Extension and Thickening Process, issued to Spann on Feb. 9, 1999. U.S. Pat. No. 5,881,737, Method of Attaching A Hair Weft To The Hair Of A Wearer, issued to Nelson on Mar. 16, 1999 discloses a hair attachment device designed to provide the appearance of longer, thicker, and fuller hair. The attachment consists of a quantity of natural or synthetic human hair that is attached at one end to self adhesive tape, which is applied to the scalp or hair of a wearer in releasable engagement thereon. While a hair attachment is relatively simple to apply, the self adhesive tape provides a less than adequate means to secure the ends of the strands of natural or synthetic hair, which can become prematurely separated from the self adhesive tape.

As such, it may be appreciated that there is a continuing need for a new and improved method and device for providing the appearance of longer and thicker hair in a manner that is relatively simple and inexpensive the achieve. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

The present version of the invention, which will be described in greater detail hereinafter, relates to the field of devices and methods that provide the appearance of longer or thicker hair. More specifically, this version of the invention is concerned with a hair attachment comprised of natural or synthetic hair that is releasably attached directly to the hair or scalp of a wearer in order to provide the wearer with the appearance of longer of thicker hair. My version of the invention overcomes all of the shortcomings listed previously, in addition to novel aspects that will be described in detail hereinafter.

Described briefly, according to a typical embodiment, the invention presents a hair attachment device or hair extension that is releasably attached to the hair or scalp of a wearer in order to provide the appearance of longer, thicker, fuller hair. The hair extension thus allows the wearer to change the appearance of their hair in order to achieve fashion styles that use longer hair or simply to enhance their appearance by achieving particular hair designs heretofore impossible without the aid of a hair extension. The hair extension that is the subject of the instant invention consists of a quantity of natural or synthetic hair strands that are disposed in parallel relation and are attached or secured at one end to a flexible strip or weft of woven material. The weave pattern of said material securely anchors the attached ends of the hair strands so that said strands do not become separated from the strip of woven material after repeated use. The weft of woven material is sufficiently flexible to accommodate the shape or any scalp or hair mass onto which it is attached. A fastener comprised of a rectangular strip of self adhesive tape with removable backing is sewn, stitched or otherwise attached to the weft of woven material in order to provide the adhesion necessary to secure the hair extension to the scalp or hair of the wearer. The hair extension can be applied to the scalp or hair of the wearer in various quantities and locations thereon as needed to achieve the desired look and appearance, although it is anticipated that the hair extensions will be applied primarily to the rear and top portions of the scalp or adjacent hair. The strands of hair secured to the weft of woven material as referenced earlier can be natural or synthetic and are also available in a variety of textures, colors, lengths, and diameters.

My invention, therefore, resides not in any one of these features per se, but rather in the particular combination of all of them herein disclosed. It is distinguished from the prior art in this particular combination of all of its structures for the functions specified.

In as much as the foregoing has outlined rather broadly the more pertinent and important features of the present invention in order that the detailed description of the invention that follows may be better understood so that the present contribution to the art can be more fully appreciated. Additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practices and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

Accordingly, it is an object of my version of the invention to provide a low-cost, easy-to-manufacture, and easy-to-market self adhesive hair extension.

A significant object of the invention is to provide a self adhesive hair extension that is comprised of a quantity of parallel arranged natural or synthetic hair strands attached at one end to a strip or weft of woven material, which is secured to the scalp or hair of a wearer by a strip of self adhesive tape.

A final but very significant object of the invention is to provide a self adhesive hair extension that provides the appearance of longer and thicker hair by overcoming the disadvantages of conventional hair enhancing and supplementing devices and techniques, such as wigs, hair weaves and braids, and removable hair extensions and attachments.

For a better understanding of the invention, its operating advantages and the specific objects attained by its uses, reference should be made to the accompanying drawings and descriptive matter in which there is illustrated a preferred embodiment of the invention. The foregoing has outlined some of the more pertinent objects of the invention. These objects should be construed to be merely illustrative of some of the more prominent features and application of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention illustrated by the accompanying drawings.

BRIEF DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DRAWING REFERENCE NUMERALS

10 Self Adhesive Hair Extension
12 Hair Strands
14 Fastener
16 Hair Attachment Weave
18 Attached End of Hair Strands
20 Unattached End of Hair Strands
22 Self Adhesive Tape
24 Tape Backing
26 Stitching
28 Wearer
30 Part Line of Hair
32 Upper Portion of Hair
34 Lower Portion of Hair

DESCRIPTION OF PREFERRED EMBODIMENT DESCRIPTION

Figure 1:
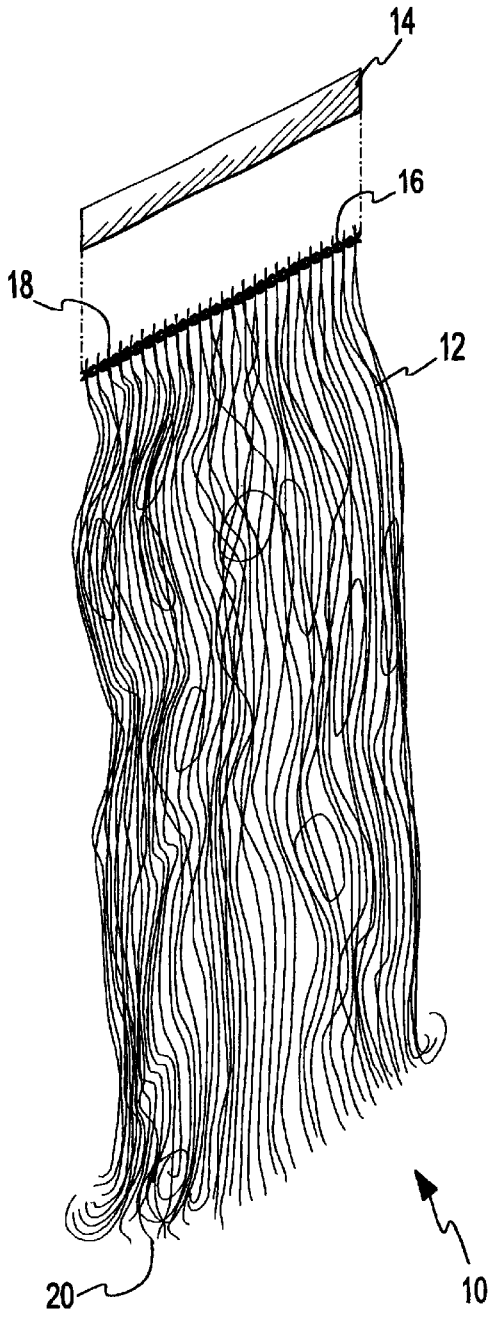
FIG. 1 is an exploded perspective view of a self adhesive hair extension in accordance with the present version of the invention illustrating the constituent components thereof.

Referring now to the drawings and, in particular, to FIG. 1 wherein there is illustrated a typical embodiment of the self adhesive hair extension 10. The present version of the invention 10 consists of a plurality of hair stands 12, fastener 14 of self adhesive tape (either single or double side layer of adhesion), and strip of woven material or hair attachment weave or weft 16. The hair strands 12 are comprised of natural or synthetic hair in a variety of lengths, diameters, textures, and colors in order to accommodate the desires and needs of a variety of wearers and fashion styles. A quantity of hair strands 12 is arranged generally in parallel arrangement so that the strands 12 are aligned at a first attached end 18 and a second attached end 20. The attached end 18 is secured or anchored in place by having the ends of individual or clumps of hair strands 12 sewn or tied to individual portions or sections of the hair attachment weave 16, e.g. base support unit, to prevent premature separation. The density and tautness of the weave pattern prevents the attached ends 18 of the hair strands 12 from becoming separated from the hair attachment weave 16. The weave 16 is comprised of flexible and durable material that conforms to the shape and contour of various scalp and scalp surfaces in order to achieve a comfortable and unobtrusive fit thereon. The fastener 14 of self adhesive tape is rectangular and preferably narrow and elongate in order to correspond to the perimeter of the hair attachment weave 16.

Figure 2:
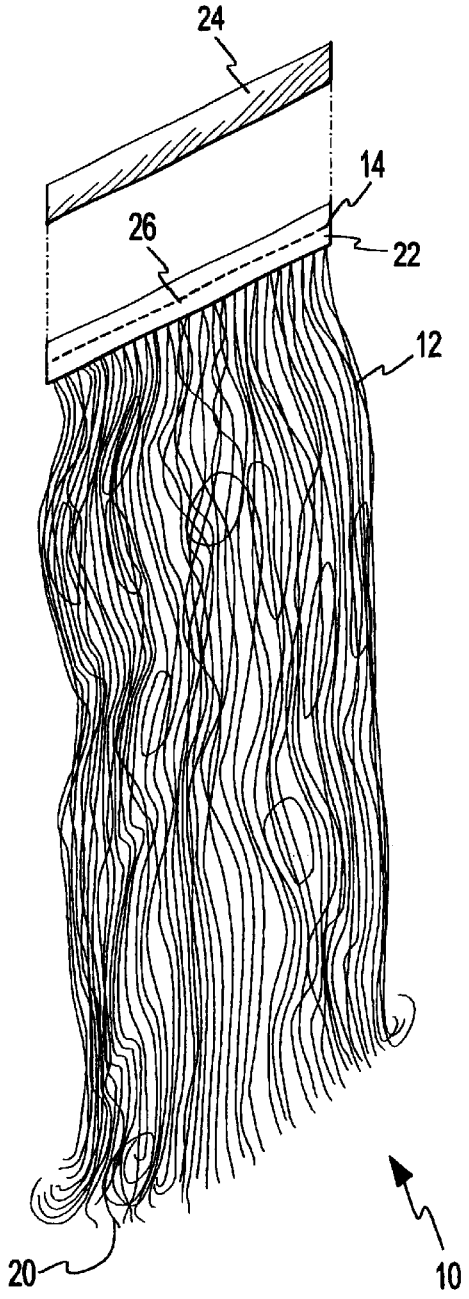
FIG. 2 is a perspective view of a self adhesive hair extension with a fastener of self adhesive tape attached to a weave or weft by means of stitching and a removable backing separated from the fastener of self adhesive tape to reveal the construction thereof.

Referring to FIG. 2, therein illustrated is the fastener 14 secured to the hair attachment weave 16 and over the attached ends 18 of hair strands 12 as configured before attachment to the scalp or hair of a wearer. The fastener 14 is comprised of a self adhesive tape portion 22 and removable backing 24. The self adhesive tape portion 22 is sewn or otherwise secured by stitching 26 to the hair attachment weave 16 in order to prevent said tape portion 22 from being separated or repositioned during use.

Figure 3:
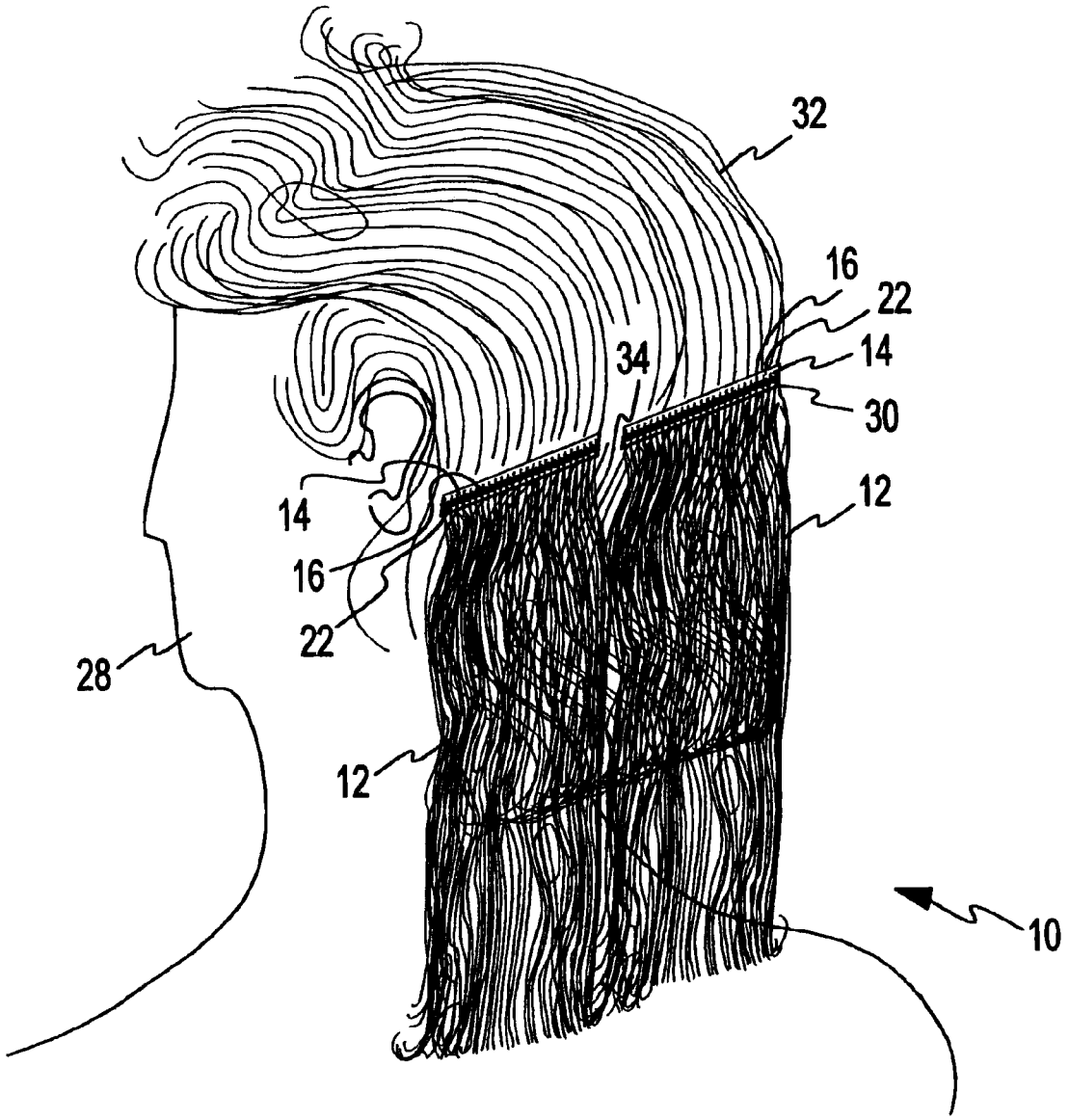
FIG. 3 is a perspective view of a self adhesive hair extension eligned for attachment to either the scalp or hair of a wearer.

In FIG. 3, two self adhesive hair extension 10 are illustrated as being attached to the rear side of the heads of a wearer 28. In this example, the wearer 28 is displayed with the hair separated along a part line 30 at the back of the head with the hair separated at said part line 30 into an upper portion 32 of hair that is temporarily swept up and away from the part line 30 over the top part of the head and pinned in place and a lower portion 34 of hair hanging directly below the part line 30. the fasteners 14 with the backing 24 removed are aligned over the part line 30 so that the self tape portions 22 and stitching 26 can make direct contact with the scalp. If necessary, the hair extensions 10 can be cut or trimmed either vertically or horizontally to conform to the existing or proposed hair style or desire of the user. Once the hair extensions 10 are aligned and secured as desired, the upper portion 32 of the hair can be dropped back to its original position to conceal the self adhesive tape portion 22 resulting in a natural, lifelike appearance of longer and thicker hair. Of course, the hair extension 10 can be attached to the head of the wearer 28 in a variety of styles and quantities and at an assortment of location and positions thereon with placement only limited by the imagination of the wearer and hair dresser. It should be pointed out that the example of attachment described previously by no means limits the spirit and scope of the invention 10 and that all possible variation of attaching the self adhesive hair extension 10 to either the scalp or hair of a wearer remains within the purview of the instant invention.

While this version of the invention has been illustrated and described in detail in the drawings and foregoing description, the same is to be considered as illustrative and not restrictive in character, it being understood that only the preferred embodiment has been shown and described and that all changes and modification that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

CONCLUSION AND SCOPE OF INVENTION

From the foregoing, it will be understood by persons skilled in the art that an improved self adhesive hair extension has been provided. The invention is relatively simple and easy to manufacture, yet affords a variety of uses. While my description contains many specificities, these should not be construed as limitations on the scope of the version of the invention, but rather as an exemplification of the preferred embodiment thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

I claim:

1. A process for attaching removable, self adhesive hair extensions to the head of a user, which comprises the steps of:

a) forming a self adhesive hair extension by arranging a quantity of hair strands in a parallel arrangement so that the hair strands are aligned at a first attached end and a second attached end, b) securing the first attached end of the hair strands to a base support unit, c) sewing a rectangular shaped, self adhesive tape having a removable back to the base support unit, d) forming a part line on the head of a user to form an upper portion of hair and a lower portion of hair, e) temporarily sweeping the upper portion of hair up and away from the part line and over the top part of the head and securing it into position, f) removing the backing from the self adhesive tape and making contact with the part line on the head of the user, aligning and securing the hair extension in place; and g) repositioning the upper portion of hair back to its original position.

2. The process according to claim 1, wherein the self adhesive hair extensions comprise:

A plurality of hair strands attached to a base support unit at one end in parallel arrangement, a fastener attached to the base support unit over the attached end of the hair strands; and a removable backing attached to the fastener.

3. The process of claim 2, wherein the base support unit is a strip of woven material.

4. The process of claim 2, wherein the base support unit is a hair attachment weave.

5. The process of claim 2, wherein the base support unit is a weft strip.

6. The process of claim 2, wherein the ahir strands are attached to the base support unit by sewing individual strands or clumps of hair to the base support unit.

7. The process of claim 2, wherein the hair strands are attached to the base support unit by tying individual strands or clumps of hair to said base support unit.

8. The process according to claim 2, wherein the removable backing exposes a portion of the fastener when removed therefrom.

9. The process of claim 1, wherein the hair strands are natural hair.

10. The process of claim 1, wherein the hair strands are synthetic hair.

* * * * *